United States Patent [19]

Eulass

[11] Patent Number: 4,482,299

[45] Date of Patent: Nov. 13, 1984

[54] WATER POWERED SUMP PUMP

[76] Inventor: David S. Eulass, 814 Fair La., Northbrook, Ill. 60062

[21] Appl. No.: 411,248

[22] Filed: Aug. 25, 1982

[51] Int. Cl.[3] ..... F04B 49/04; F04F 5/48

[52] U.S. Cl. ..... 417/54; 417/40; 417/87; 417/182.5; 417/187

[58] Field of Search ..... 417/40, 181, 172, 187, 417/194, 151, 182.5, 195, 87

[56] References Cited

U.S. PATENT DOCUMENTS

| | | | |
|---|---|---|---|
| 1,177,270 | 3/1916 | Pursell | 417/182.5 |
| 1,230,972 | 6/1917 | Woodworth | 417/182.5 |
| 2,006,615 | 7/1935 | Yoder | 417/182.5 |
| 2,085,361 | 6/1937 | Hellmer | 417/195 |
| 2,855,861 | 10/1958 | Miles et al. | 417/187 X |
| 2,915,975 | 12/1959 | Kittrell et al. | 417/9 |
| 2,935,029 | 5/1960 | Miles | 417/187 X |
| 3,472,172 | 10/1969 | Vignerot | 417/187 X |
| 3,726,606 | 4/1973 | Peters | 417/17 |
| 3,963,376 | 6/1976 | Miskin | 417/40 |
| 4,065,226 | 12/1977 | Campbell | 417/40 |

*Primary Examiner*—Edward K. Look

*Attorney, Agent, or Firm*—Hill, Van Santen, Steadman & Simpson

[57] ABSTRACT

A water powered sump pump having an ejector with an inlet end and a discharge end and enclosed within a housing providing support for the ejector. A control chamber about the inlet end of the ejector has a diaphragm valve which operates to control communication with a water pressure source responsive to operation of a float controlled pilot valve. Multi-stage turbulence and progressively increasing energy and velocity is effected in sump water directed to a propulsion zone defined about the ejector nozzle and communicating with the mouth end of a venturi leading to a discharge outlet from the ejector.

16 Claims, 6 Drawing Figures

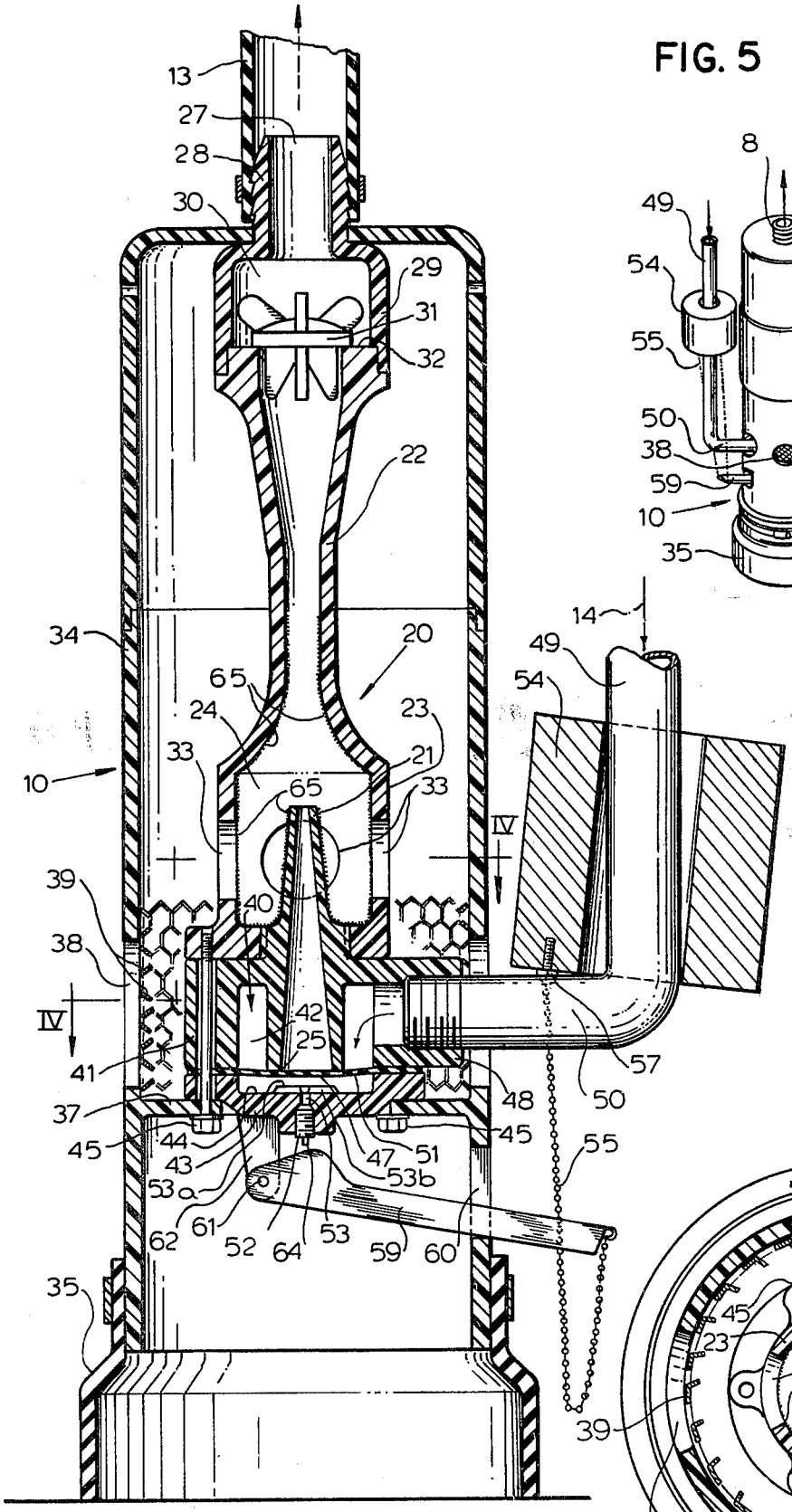
FIG 2
FIG. 5
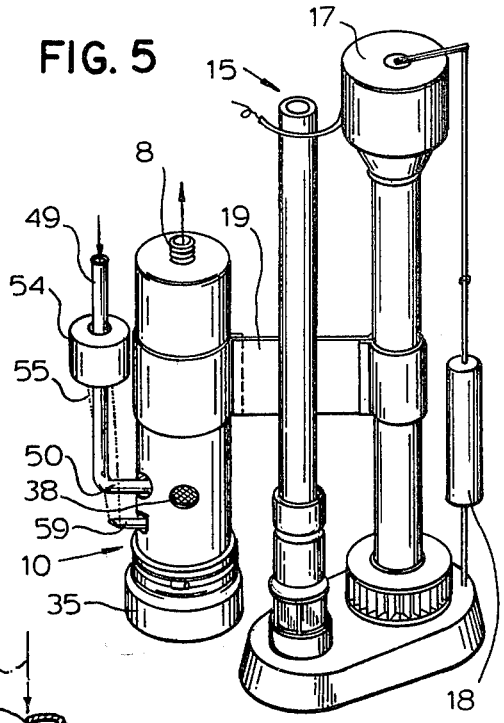
FIG 4
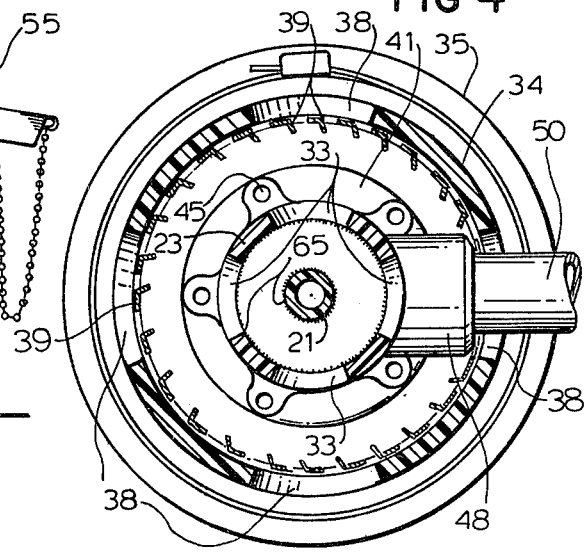

WATER POWERED SUMP PUMP

The present invention relates to water powered sump pumps, and is more particularly concerned with increasing the capacity and efficiency of such pumps.

Water powered sump pumps have heretofore been proposed but have not, apparently, been of acceptable capacity and efficiency. This may be presumed from the fact that while various prior art arrangements are known, there is presently a dearth of such devices available on the market, and there appears to be universal reliance on electrical motor driven sump pumps. The manifest disadvantage of electrical motor drives for sump pumps is that when there is an electrical failure or outage, as is often the case during stormy weather when there is crucial need for sump pump operation to avoid flooding, the sump pump cuts out.

Examples of prior attempts to provide water powered sump pumps are disclosed in U.S. Pat. Nos. 1,177,270 and 1,230,972, which are early examples, and U.S. Pat. No. 3,963,376, which is a more recent example. All of these examples have float operated means for controlling water pressure supplied to an ejector which causes a suction type of ejection of sump water. These prior arrangements are deficient in several respects, among which may be mentioned limited sump water to operating water pressure ratio, complex designs, high equipment costs, high operating costs, and the like.

Auxilliary or safety sump pump arrangements comprising storage battery powered electrical motors have been proposed, a typical example being found in U.S. Pat. No. 3,726,606. Such arrangements have the disadvantage of the considerable storage battery costs, liability of battery and motor deterioration in lengthy periods of inactivity, switch deterioration and failure, and the like.

Accordingly, it is an important object of the present invention to provide a new and improved water powered sump pump which will overcome the disadvantages, drawbacks, inefficiencies, shortcomings and problems inherent in prior arrangements.

To this end, the present invention provides in a water powered sump pump having an ejector with an inlet end and a discharge end and provided with an intermediate propulsion zone, means for effecting communication of a continuous water pressure source with the intake end, and float controlled valve means for normally closing the inlet end and openable to permit the water pressure to enter the inlet end and effect operation of the ejector when a predetermined rise in water level occurs in an associated sump, the improvement comprising sump water intake structure arranged to direct sump water to flow into the structure through an entrance arrangement and then on through the structure substantially uniformly to the ejector, for ejection from said discharge end by operation of the ejector; the intake structure having means for effecting turbulence in, and for progressively increasing the energy and velocity of, the sump water as it flows from the entrance arrangement to the propulsion zone, so that maximum sump water pumping efficiency is attained.

The present invention also provides in a water powered sump pump having an ejector with an inlet end and a discharge end and means for directing sump water to said ejector, the improvement comprising means defining a chamber about and enclosing the inlet end, an inlet end closing diaphragm valve dividing the chamber into an intake subchamber and a valve biasing pressure chamber, means for effecting communication of a continuous water pressure source with the intake subchamber, a metering bypass orifice for bleeding water pressure from the intake subchamber into the biasing pressure subchamber, a normally closed pilot valve controlling a dump port from the biasing pressure subchamber so that water pressure bleeding into this subchamber will normally bias the diaphragm valve into closing relation to the inlet, float control means for opening the pilot valve for dumping the water from the biasing pressure subchamber and thereby opening the diaphragm valve responsive to water pressure in the intake subchamber when a predetermined rise in water level occurs in a sump in which the sump pump may be located, operation of the ejector by action of the water pressure released thereto by opening of the diaphragm valve being adapted to effect ejection of the sump water through the discharge end.

Other objects, features and advantages of the invention will be readily apparent from the following description of representative embodiments thereof, taken in conjunction with the accompanying drawings, although variations and modifications may be effected without departing from the spirit and scope of the novel concepts embodied in the disclosure and in which:

FIG. 2 is an enlarged vertical sectional view taken substantially along the line II—II of FIG. 1 and showing the pump in an inactive state;

FIG. 4 is a horizontal sectional view taken substantially along the line IV—IV of FIG. 2;

FIG. 5 is a perspective view showing the water powered sump pump of the present invention associated as an auxillary or safety pump with an electrically powered sump pump.

Figure 1:
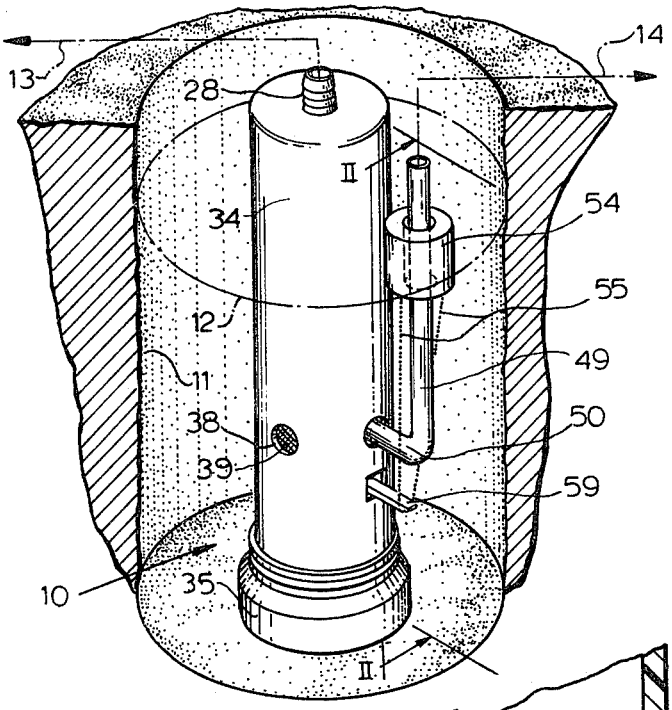
FIG. 1 is a more or less schematic perspective view showing a water powered sump pump embodying the present invention mounted in a sump.

As shown in FIG. 1, a water powered sump pump 10 embodying the present invention is adapted to be located in a sump 11 for drainage through a discharge duct 13 of water 12 collected in the sump. Water power for operating the pump 10 is adapted to be delivered from a water pressure source such as a municipal water supply, through a water line 14 leading from a water main. As thus depicted, the sump pump 10 may serve as the prime or sole sump pump in the installation.

On the other hand, as shown in FIG. 5, the water powered sump pump 10 may serve as an auxillary or standby safety pump in association with a standard sump pump 15 operated by means of an electrical motor 17 through a suitable switch arrangement controlled by a float 18. For this purpose, the water powered sump pump 10 may be connected to the electrically operated primary sump pump 15 as by means of a bracket 19 where a unitary arrangement for handling is desired.

Referring to FIG. 2, details of a preferred embodiment of the water powered sump pump 10 are shown. At the heart of the pump 10 is an ejector 20 comprising a water jet nozzle 21 and a venturi 22 with the flaring mouth end of the venturi merging with an enlarged housing portion 23 defining a chamber 24 providing an intermediate propulsion zone about the jet orifice portion of the nozzle 21 which is coaxially aligned with the passage through the venturi 22. At its downstream, larger diameter end, the nozzle 21 extends substantially below the chamber 24, as shown, and provides an inlet end for the ejector 20. A discharge end 27 for the venturi 22 is provided at its upper end by a nipple 28 to which the discharge duct 13 is adapted to be attached, substantially as shown. In a desirable arrangement, the discharge nipple 28 is provided on a housing enlargement 29 secured to the upper end of the venturi 22 and defining a check valve chamber 30 in which is contained a pressure responsive check valve 31 adapted to seat on a valve seat 32 about the upper end of the venturi passage to prevent backflow of water when the ejector is inactive. Dynamic water pressure ejected from the nozzle 21 into the venturi 22 causes sump water entering the chamber 24 through a plurality such as four, intake ports 33 (FIGS. 2 and 4) to be drawn into and through the venturi and discharged past the valve 31 and out through the outlet 27.

Support for the ejector 20 is desirably provided by means of a tubular housing 34 mounted on a supporting base 35 and having at a proper elevation above the base an annular platform or ledge shoulder 37 on which the lower end portion of the ejector is mounted in centered relation. Above the shoulder 37 and below the ports 33, the housing 34 provides an intake structure provided in part by a plurality, such as three, sump water intake ports 38 providing an entrance arrangement for directing sump water to flow into the intake structure of which the intake ports 33 are also a part and direct the sump water substantially uniformly to the ejector 20 for ejection from the discharge end 27 by operation of the ejector.

Means are provided in connection with the intake structure for effecting turbulence in and for progressively reducing the loss of energy and increasing the velocity of the sump water as it flows from the entrance ports 38 to the propulsion zone 24, so that maximum sump water pumping efficiency is attained. As a first stage turbulence and water energy enhancing means, turbulence generating combination screen and louver structure 39 is mounted across the intake ports 38. Conveniently, the louver structure 39 may be in the form of a piece of conventional expanded metal 40 or its equivalent mounted within the tubular housing 34 over the ledge or shoulder 37 and extending across the ports 38.

In a second stage turbulence and water energy throughput enhancing means, the cross sectional flow area of the ports 30 is smaller than the cross sectional flow area of the ports 38, so that there is a pressure drop and velocity acceleration and further turbulence as the sump water passes through the ports 33 into the propulsion zone 24.

At the top of the propulsion zone 24 where it merges into the lower end of the venturi 22, there is provided a third stage water acceleration, velocity increasing means due to the cross-sectional flow reduction cooperating with the ejection jet from the ejector nozzle 21.

As a result of the multi-stage progressive increase in energy throughput and velocity of the sump water as it flows from the entrance arrangement provided by the ports 38 and associated structure, and the ports 33 as well as the propulsion zone 24, maximum sump water pumping efficiency is attained.

For controlling water pressure to the ejector nozzle 21, means are provided defining a water pressure chamber 40 about and enclosing the inlet end 25. For this purpose, the nozzle 21 is carried by a base block 41 which is provided with an annular recess 42 forming a subchamber about the lower portion of the nozzle 21 and cooperating with a base closure plate 43 which has a recess 44 defining a lower subchamber portion of the chamber 40. Means such as screws 45 are adapted to secure the block 41 and base plate 43 in assembly with the shoulder ledge 37 and this lower end of the enlargement 23.

A flexible diaphragm 47 of a diameter to be marginally clamped between the block 41 and the base plate 43 serves as a control valve dividing the subchambers 42 and 44 and normally closes the inlet 25 which provides a seat for the diaphragm. It will be noted that the valve seat inlet end 25 projects below the plane of the clamping face provided by the block 41 so that in its closed position the diaphragm 47 will be positively stretched against the seat. Therefore, in the event of a water source pressure failure or shutoff, reverse flow contamination into the pressure supply line will be precluded.

Means comprising a hollow boss 48 communicating with the subchamber 42 is adapted for connection of the continuous water pressure source through the water line 14. Desirably, the water line 14 includes a vertical pipe arm 49 which extends upwardly in spaced parallel relation to the housing 34 and has a lower right angular leg 50 which is secured into the boss 48. Normally, the water under pressure supply through the line 14 into the inlet subchamber 40 would tend to displace the diaphragm valve 47 from the inlet 25, but during the inactive stage of the sump pump 10, a metering bypass orifice 51, in this instance, located in the portion of the diaphragm 47 which is freely exposed to the subchambers 42 and 44 in the space between the inlet 25 and the wall defining the outside diameter of the chamber 40, bleeds water pressure from the inlet subchamber 42 into the subchamber 44. The water pressure in the subchamber 44 biases the diaphragm 47 into closing relation to the inlet 25 by virtue of the differential areas of the diaphragm exposed to the water pressure at the inlet subchamber side as compared to the pressure subchamber side.

Figure 3:
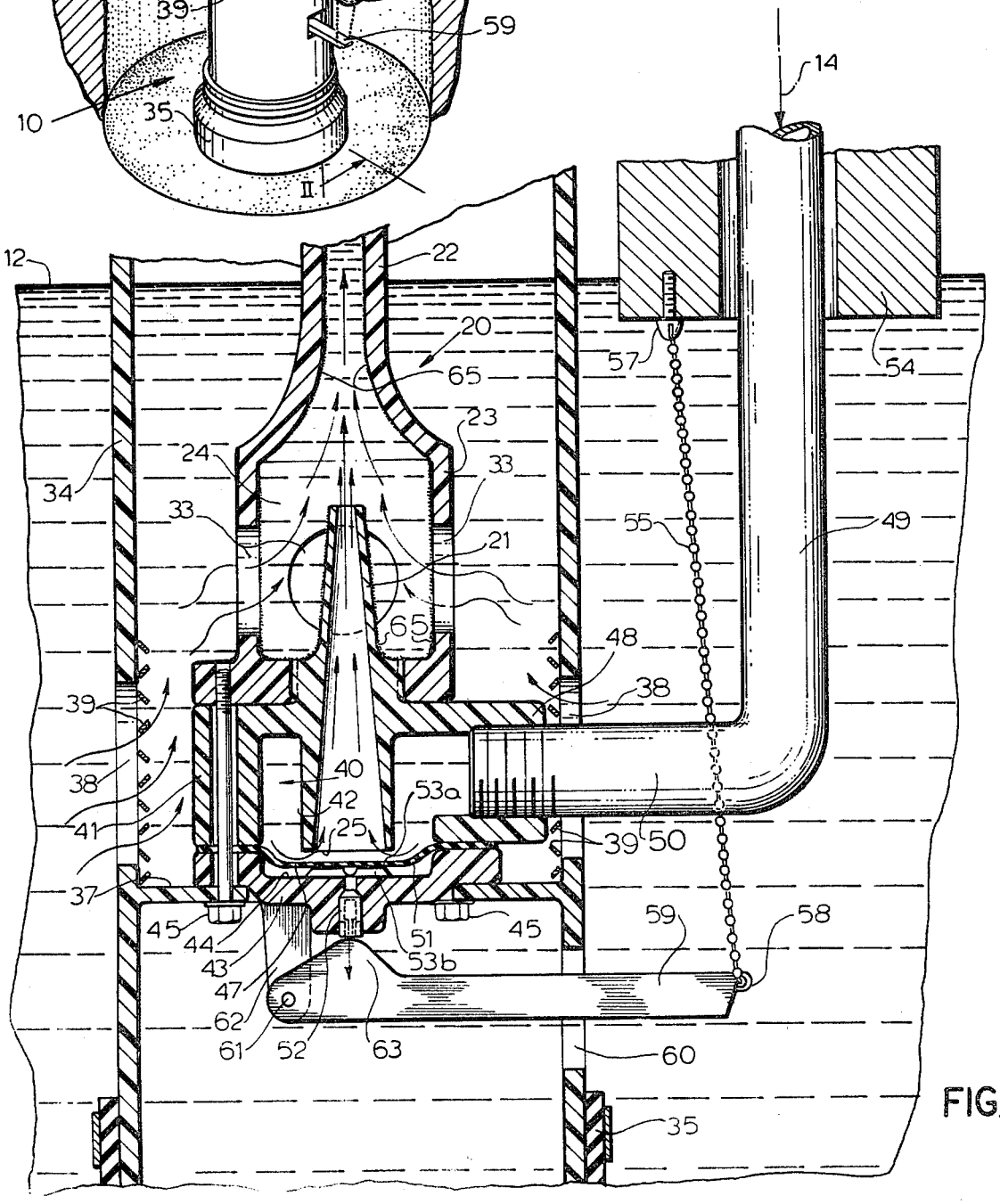
FIG. 3 is a fragmentary vertical sectional view similar to FIG. 2 but showing the pump in its active sump water pumping state.

Normally, the biasing pressure subchamber 44 is closed against escape of pressure therefrom. However, a normally closed pilot valve 52 is provided for controlling a dump port 53 leading from the biasing pressure subchamber 44 through a boss 53*a* so that water pressure bleeding into the subchamber 44 and which normally biases the diaphragm valve 47 into the closing relation to the inlet 25 can be dumped through the port 53 to open the diaphragm valve. For this purpose, the port 53 is desirably at least twice the cross-sectional flow area as compared to the metering bypass orifice 51 which is merely a tiny hole, for example, about 0.0125 inch diameter as compared to about 0.032 inch diameter for the dump port 53. In the preferred arrangement, the dump port 53 is axially aligned under the inlet 25 and the inner end of the port 53 is located in limited spaced relation to the inlet 25 so as to permit an ample range of movement between opened and closed positions of the flexible diaphragm 47, and so that when the diaphragm is unseated from the inlet 25, it will be urged to travel to a limiting stop provided by the boss 53*a*, as best seen in FIG. 3. A pressure stabilizing slot 53*b* provides a bleed passage past the diaphragm travel stop, from the subchamber 44 to the port 53.

For opening the pilot valve 52 for dumping the water from the biasing pressure subchamber 44, float control means are provided comprising, in a preferred arrangement, an annular float 54 which is freely vertically moveably mounted about the vertical water delivery arm 49 and in a fully inactive position adapted to rest on the leg 50 as shown in FIG. 2. Flexible connecting means desirably comprising a bead chain 55 in the form of an elongated loop is connected at its free ends as by means of screws 57 to the lower end of the float 54 and loops down about the pipe leg 50 and is connected as by means of an underturned securing or anchoring terminal 58 to the distal end of an operating lever 59 which projects out from a clearance aperture 60 in the lower portion of the housing 34 above the base 35 and has its inner end portion underlying the pilot valve 52 and connected pivotally as by means of a pin 61 to mounting ear structure 62 depending from the base plate 43. At its inner end portion, the operating lever arm 59 has means comprising an upwardly projecting valve actuating hump or boss 63 of rounded contour which is adapted when the lever arm 59 is swung upwardly from its at rest position shown in FIG. 2 into its operating position as shown in FIG. 3, to depress a downwardly projecting operating plunger 64 of the pilot valve 52 for opening the pilot valve to dump the pressure from the pressure subchamber 44. It will be observed that the length of the chain 55 is such that there is a substantial range of movement permitted for the control float 54 until the level of water 12 rises to a height where it is desirable to activate the pump for discharging the water from the sump.

Figure 6:
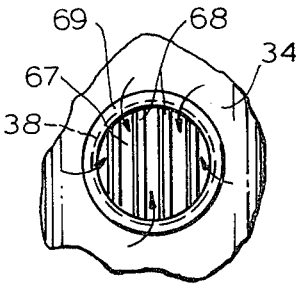
FIG. 6 is a fragmentary elevational view showing a modified form of sump water intake agitating louver structure.

In another form of combination screen and turbulence effecting means as shown in FIG. 6, a louver 67 is adapted to be mounted across each of the intake ports 38 per each of the louver screens 67 and may have louver vanes 68 carried by an annular mounting ring 69 which is adapted to be fixed into the associated port 38.

In operation of the water powered sump pump 10, the float 54 rises with the water 12 until the chain 55 pulls and swings the lever arm 59 upwardly and the knob 63 depresses the pilot valve plunger 64, opening the pilot valve 52 and dumping the pressure from the pressure subchamber 44. Water pressure in the inlet subchamber 42 forces the diaphragm valve 47 away from the inlet 25 and the water pressure rushes up through the nozzle 21 as indicated by flow arrows in FIG. 3.

Hydraulic force of the jet stream emitted from the nozzle 21 into the spaced lower end mouth of the venturi 22 enduces and accelerates large volume intake flow of sump water into the chamber 24 and on through the venturi 22 for discharge to drain by way of the duct 13. Within the chamber 24, and at least in the entry portion of the venturi 22, boundary layer turbulence is effected in respect to the indrawn and ejected sump water by having surface roughening means 65 covering substantially all of the surfaces exposed to the sump water in the chamber 24, including the entrance mouth end of the venturi 22 and extending at least part way up the venturi passage. This substantially improves efficiency of the ejector action by reducing boundary layer drag.

As explained hereinbefore, the sump water drawn into and hydraulically propelled by means of the ejector 20 is subjected to turbulence and progressively increasing energy throughput and velocity in movement into the venturi 20. On passing through the turbulence effecting screen 39 at the intake ports 38, turbulence is enhanced by means of the outer wall defining the block 41 spaced uniformly opposite the ports 38 and extending upwardly from the shoulder 37 together with the base portion of the chamber defining enlargement 23 secured to the top of the block 41, and providing, in effect, a pressure drop at the top of the annular passage thus provided. Thereby, the inrushing sump water maintains a thoroughly turbulent and increasing velocity motion on through the intake ports 33 into the chamber 24 where the turbulent agitation is maintained and further enhanced as the sump water is propelled on into the venturi 22 and therein further accelerated for discharge.

Experimental testing of the water powered sump pump 10 has demonstrated quite efficient sump drainage with only moderate water pressure usage, attaining an at least 3 to 1 ratio, that is, at least 3 gallons of sump water pumped out for each gallon of water pressure utilized where such pressure is in a range of about 25 psi to 60 psi. Stated another way, the pump 10 is adapted to handle from about 900 to 1200 gallons per hour of water with an input of about 200 to 375 gallons per hour of source water within the usual range of municipal water main pressures.

It will be understood that variations and modifications may be effected without departing from the spirit and scope of the novel concepts of this invention.

I claim as my invention:

1. A water powered sump pump having an ejector with an inlet end and a discharge end and provided with an intermediate propulsion zone, means for effecting communication of a continuous water pressure source with the intake end, and float controlled valve means for normally closing the inlet end and openable to permit the water pressure to enter the inlet end and effect operation of the ejector when a predetermined rise in water level occurs in an associated sump, the improvement comprising:

sump water intake structure arranged to direct sump water to flow into the structure through an entrance arrangement and then on through the structure substantially uniformly to the ejector, for ejection from said discharge end by operation of the ejector;

said intake structure having means for effecting turbulence in, and for progressively increasing the energy throughput and velocity of, the sump water as it flows from the entrance arrangement to the propulsion zone, so that maximum sump water pumping efficiency is attained;

and means in said propulsion zone for effecting turbulence and substantially eliminating boundary layer drag.

2. A pump according to claim 1, wherein said intake structure includes a housing spaced about said ejector, and said entrance arrangement comprises intake ports for substantially uniformly directing the sump water into the space between said housing and said ejector.

3. A pump according to claim 2, wherein said means for effecting turbulence comprises combination screen and turbulence effecting means extending across said intake ports.

4. A pump according to claim 3, including sump water directing means spaced from said intake ports and effective to enhance turbulence and water flow energy throughput toward said propulsion zone.

5. A pump according to claim 4, wherein said propulsion zone comprises a chamber about an ejector nozzle discharging into a venturi throat, and a plurality of uniformly spaced ports lead into said chamber about said nozzle and are of a combined cross-sectional flow area less than the cross-sectional flow area through said intake ports.

6. A pump according to claim 5, wherein said nozzle has a jet emitting tip spaced from said venturi throat, and walls defining said chamber and said throat define a third stage sump water velocity accelerating area wherein said intake ports provide a first stage acceleration area and said ports into said chamber provide a second stage acceleration area.

7. A water powered sump pump according to claim 1, including means defining a chamber about and enclosing said inlet end, an inlet end closing diaphragm valve dividing said chamber into an inlet subchamber and a valve biasing pressure subchamber, means for effecting communication of said continuous water pressure source with said inlet subchamber, a metering bypass orifice for bleeding water pressure from said inlet subchamber into said biasing pressure subchamber, a normally closed pilot valve controlling a dump port from said biasing pressure subchamber so that water pressure bleeding into this subchamber will normally bias said diaphragm valve into closing relation to said inlet, float control means for opening said pilot valve for dumping the water from said biasing pressure subchamber and thereby opening said diaphragm valve responsive to water pressure in said inlet subchamber when a predetermined rise in water level occurs in the associated sump, operation of said ejector by action of the water pressure released thereto by opening of said diaphragm valve being adapted to effect ejection of the sump water through said discharge end.

8. In a water powered sump pump having an ejector with an inlet end and a discharge end and means for directing sump water to said ejector, the improvement comprising:

means defining a chamber about and enclosing the inlet end;

an inlet end closing diaphragm valve dividing the chamber into an inlet subchamber and a valve biasing pressure subchamber;

means for effecting communication of a continuous water pressure source with the inlet subchamber;

a metering bypass orifice for bleeding water pressure from the inlet subchamber into the biasing pressure subchamber;

a normally closed pilot valve controlling a dump port from the biasing pressure subchamber so that water pressure bleeding into this subchamber will normally bias the diaphragm valve into closing relation to the inlet;

float control means for opening the piot valve for dumping the water from the biasing pressure subchamber and thereby opening the diaphragm valve responsive to water pressure in the inlet subchamber when a predetermined rise in water level occurs in a sump in which the sump pump may be located;

operation of the ejector by action of the water pressure released thereto by opening of the diaphragm valve being adapted to effect ejection of the sump water through the discharge end;

and roughening means on wall surfaces of said discharge end for effecting boundary layer turbulence and thereby accelerating said ejection.

9. A pump according to claim 8, wherein said means for directing sump water to said ejector comprises sump water intake structure arranged to direct sump water to flow into said structure through an entrance arrangement and then on through said structure substantially uniformly to said ejector, for ejection from said discharge end by operation of the ejector; said intake structure having means for effecting turbulence, and for progressively increasing the energy throughput and velocity of, the sump water as it flows from said entrance arrangement to said propulsion zone, so that maximum sump water pumping efficiency is attained.

10. A pump according to claim 8, wherein said dump port is located in alignment with said inlet end in a bottom wall defining said biasing pressure subchamber and said diaphragm valve is adapted to close said port, except for a stability bleed leading to said dump port from said pressure subchamber, when said diaphragm valve opens said inlet.

11. A pump according to claim 10, wherein said pilot valve has an operating plunger projecting outwardly from said wall, a pivoted lever arm carried by the outer side of said wall, a float attached by flexible connection means to said lever arm and adapted to move said lever arm for depressing said plunger for opening said pilot valve upon rising of the float in sump water.

12. A pump according to claim 11, wherein said means for effecting communication of a continuous water pressure source comprises a vertically extending pipe arm and said float is of annular form and mounted about and guided by said pipe arm, a lower end angular leg on said pipe arm providing a rest for said float in an inactive state of the float.

13. A pump according to claim 11, wherein said flexible connecting means comprises a bead chain.

14. A method of pumping in a water powered sump pump having an ejector with an inlet end and a discharge end directed into an intermediate propulsion zone, and including effecting communication of a continuous water pressure source with said intake end, normally closing said inlet end with float control valve means, and opening said valve means and permitting water pressure to enter said inlet end and effect operation of the ejector when a predetermined rise in water level occurs in an associated sump, and comprising:

in the operation of the ejector causing sump water to flow into a sump water intake structure through an entrance arrangement and then on through the structure substantially uniformly to said propulsion zone;

effecting turbulence in and progressively increasing the energy throughput and velocity of the sump water into said intake structure from said entrance arrangement to and through said propulsion zone, and thereby attaining maximum sump water pumping efficiency by operation of said ejector; and substantially eliminating boundary layer drag by effecting turbulence in said propulsion zone.

15. A method according to claim 14, which includes providing walls defining said propulsion zone with roughening means and thereby effecting said turbulence in said propulsion zone and accelerating the pumping effect of said ejector.

16. A water powered sump pump having an ejector with an inlet end and a discharge end and provided with an intermediate propulsion zone, means for effecting communication of a continuous water pressure source with the intake end, and float controlled valve means for normally closing the inlet end and openable to permit the water pressure to enter the inlet end and effect operation of the ejector when a predetermined rise in water level occurs in an associated sump, the improvement comprising:

sump water intake structure arranged to direct sump water to flow into the structure through an entrance arrangement and then on through the structure substantially uniformly to the ejector, for ejection from said discharge end by operation of the ejector;

said intake structure having means for effecting turbulence in, and for progressively increasing the energy throughput and velocity of, the sump water as it flows from the entrance arrangement to the propulsion zone, so that maximum sump water pumping efficiency is attained;

said intake structure including a housing spaced about said ejector, and said entrance arrangement comprising intake ports for substantially uniformly directing the sump water into the space between said housing and said ejector;

said means for effecting turbulence comprising combination screen and turbulence effecting means extending across said intake ports;

sump water directing means spaced from said intake ports and effective to enhance turbulence and water flow energy throughput toward said propulsion zone;

said propulsion zone comprising a chamber about an ejector nozzle discharging into a venturi throat, and a plurality of uniformly spaced ports leading into said chamber about said nozzle and being of a combined cross-sectional flow area less than the cross-sectional flow area through said intake ports;

said nozzle having a jet emitting tip spaced from said venturi throat, and walls defining said chamber and said throat defining a third stage sump water velocity accelerating area wherein said intake ports provide a first stage acceleration area and said ports into said chamber provide a second stage acceleration area;

and wall areas within said chamber and venturi mouth as well as said nozzle having boundary layer turbulence promoting means thereon.

* * * * *